US006990881B2

(12) United States Patent
Lin

(10) Patent No.: US 6,990,881 B2
(45) Date of Patent: Jan. 31, 2006

(54) WORKPIECE HOLDING-DOWN STRUCTURE FOR BLIND CUTTING MACHINE

(75) Inventor: Jung-Kuei Lin, Hsinchu (TW)

(73) Assignees: Industrial Technology Research Institute, Hsinchu Hsien (TW); Nien Made Enterprise Co., Ltd., Taichung (TW)

( * ) Notice: Subject to any disclaimer, the term of this patent is extended or adjusted under 35 U.S.C. 154(b) by 129 days.

(21) Appl. No.: 10/395,180

(22) Filed: Mar. 25, 2003

(65) Prior Publication Data

US 2004/0112194 A1 Jun. 17, 2004

(30) Foreign Application Priority Data

Dec. 16, 2002 (TW) ..... 91220672 U

(51) Int. Cl.
*B26D 7/02* (2006.01)

(52) U.S. Cl. ..... 83/462; 83/463; 83/466

(58) Field of Classification Search ..... 83/466, 83/462, 446, 447, 450, 457, 458, 463, 459, 83/460, 451, 452, 464, 448, 468.5, 468.6, 83/468.7, 422, 418; 269/151, 45, 63, 209; 144/253.5, 253.6, 306, 307, 308

See application file for complete search history.

(56) References Cited

U.S. PATENT DOCUMENTS

| | | | | |
|---|---|---|---|---|
| 475,782 | A * | 5/1892 | Luger | 144/253.1 |
| 1,569,236 | A * | 1/1926 | Puterbaugh | 144/307 |
| 2,121,349 | A * | 6/1938 | Peddicord | 83/729 |
| 2,525,894 | A * | 10/1950 | Graham | 144/250.2 |
| 2,783,796 | A * | 3/1957 | Patterson | 144/253.6 |
| 3,457,972 | A * | 7/1969 | Johnson | 83/449 |
| 4,476,757 | A * | 10/1984 | Morris | 83/446 |
| 5,103,704 | A * | 4/1992 | Spath et al. | 83/452 |
| 6,446,687 | B1 * | 9/2002 | Jukoff | 144/253.6 |
| 6,543,973 | B2 * | 4/2003 | Lapikas et al. | 83/468.6 |
| 6,619,643 | B1 * | 9/2003 | Hayday | 269/139 |
| 6,644,160 | B1 * | 11/2003 | Boselli | 83/518 |

FOREIGN PATENT DOCUMENTS

GB 2179293 * 3/1987

* cited by examiner

*Primary Examiner*—Stephen Choi
(74) *Attorney, Agent, or Firm*—Bacon & Thomas, PLLC

(57) ABSTRACT

A workpiece holding-down structure is used in a blind cutting machine and adapted to hold down a blind in a cutter unit of the blind cutting machine. The workpiece holding-down structure includes a workpiece feeder abutted against the cutter unit, and a clamp installed in the workpiece feeder. The clamp has a clamping bar unit fastened pivotally with a bottom wall of the workpiece feeder near one lateral side of the workpiece feeder and adapted to push a blind been put in the workpiece feeder toward the other lateral side of the workpiece feeder and to further hold down the blind for cutting.

6 Claims, 6 Drawing Sheets

WORKPIECE HOLDING-DOWN STRUCTURE FOR BLIND CUTTING MACHINE

BACKGROUND OF THE INVENTION

1. Field of the Invention

The present invention relates generally to a blind cutting machine and, more specifically, to a workpiece holding-down structure for use in a blind cutting machine to hold down a blind for cutting. The invention relates also to a blind cutting machine having such a workpiece holding-down structure.

2. Description of the Related Art

Due to mass production, blind manufacturers provide few sizes (lengths of headrail, bottom rail and slats) for each model. However, a house commonly has windows of different sizes subject to different lighting designs. Distributors or upholsterers may have to cut blinds purchased from factories subject to different windows to be covered with blinds. Various blind cutting machines have been disclosed, and have appeared on the market. A blind cutting machine generally comprises a cutter unit and a workpiece feeder. During operation, the blind to be cut is put in the workpiece feeder in a horizontal position and inserted through the cutter unit, and then the cutter unit is started to cut the blind. When cutting a blind, the parts of the blind must be gathered and held down in the cutting position. If the parts of the blind are not gathered and held down in the cutting position, the parts may be cut at different lengths, and the cut edges of the parts of the blind may be squeezed against one another, resulting in the presence of burs at the cut edges. In order to eliminate this problem, a vice or the like is used in the workpiece feeder to hold down the front ends of the parts of the blind in front of the cutter unit. However, because a blind is comprised of a number of elongated parts, simply holding down the front ends of the parts cannot keep the parts tightly together in a good order. Therefore, the operator has to arrange the rear ends of the parts in the workpiece feeder manually, and then insert the front ends of the parts of the blind through the cutter unit. This cutting procedure takes much time and labor, and the operator will tire very soon. When the operator became weary, he (she) may be unable to control the cutting quality well. Further, a vice for this purpose is complicated, and its use deters the speed of the cutting operation.

SUMMARY OF THE INVENTION

The present invention has been accomplished under the circumstances in view. It is therefore the main object of the present invention to provide a workpiece holding-down structure for blind cutting machine, which improves the blind cutting efficiency of the blind cutting machine.

It is another object of the present invention to provide a workpiece holding-down structure for blind cutting machine, which is simple and inexpensive to manufacture.

To achieve these objects of the present invention, the workpiece holding-down structure comprises a workpiece feeder having a front side abutted against a cutter unit of the blind cutting machine, and a rear side; and a clamp installed in the workpiece feeder and adapted to hold down a blind for cutting by the cutter unit of the blind cutting machine. The clamp has a clamping bar unit fastened pivotally with a bottom wall of the workpiece feeder near a first lateral side of the workpiece feeder and adapted to push a blind been put in the workpiece feeder toward a second lateral side of the workpiece feeder and to further hold down the blind for cutting.

DETAILED DESCRIPTION OF THE INVENTION

Figure 1:
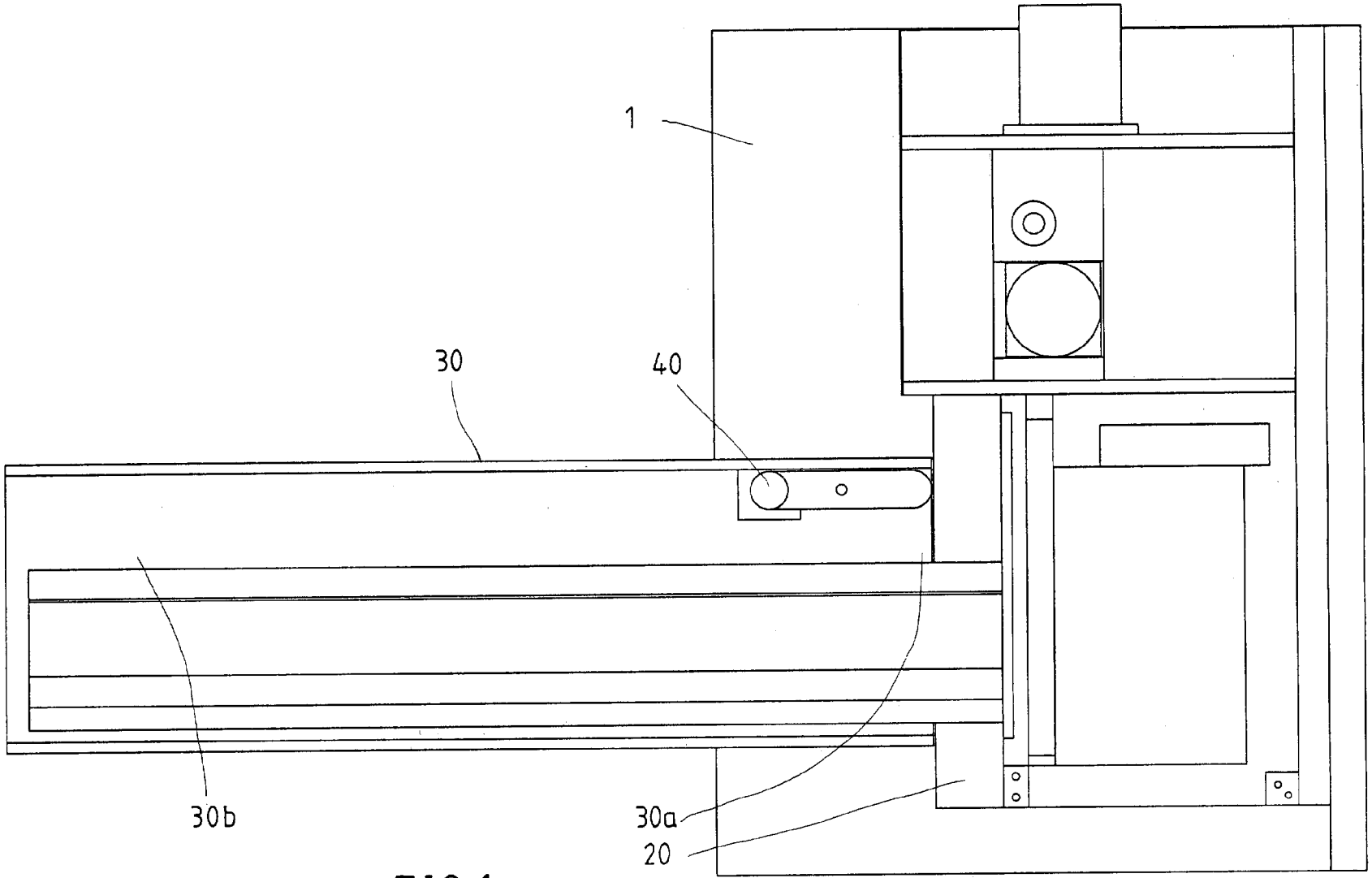
FIG. 1 is a top view showing a workpiece holding-down structure installed in a blind cutting machine according to the present invention.

Referring to FIG. 1, a blind cutting machine 1 is shown comprised of a cutter unit 20, and a workpiece feeder 30.

The cutter unit 20 has a cutter tool adapted to be reciprocated horizontally to cut off the workpiece been set in the reciprocating path of the cutter tool. The cutter unit 20 is constructed according to conventional techniques. Because the cutter unit 20 is of the known art, no further detailed description in this regard is necessary. The workpiece feeder 30 is made from a metal plate by stamping, having a front side 30*a* and a rear side 30*b*. The front side 20*a* of the workpiece feeder 30 is abutted against the cutter unit 20 of the blind cutting machine 1.

Figure 2:
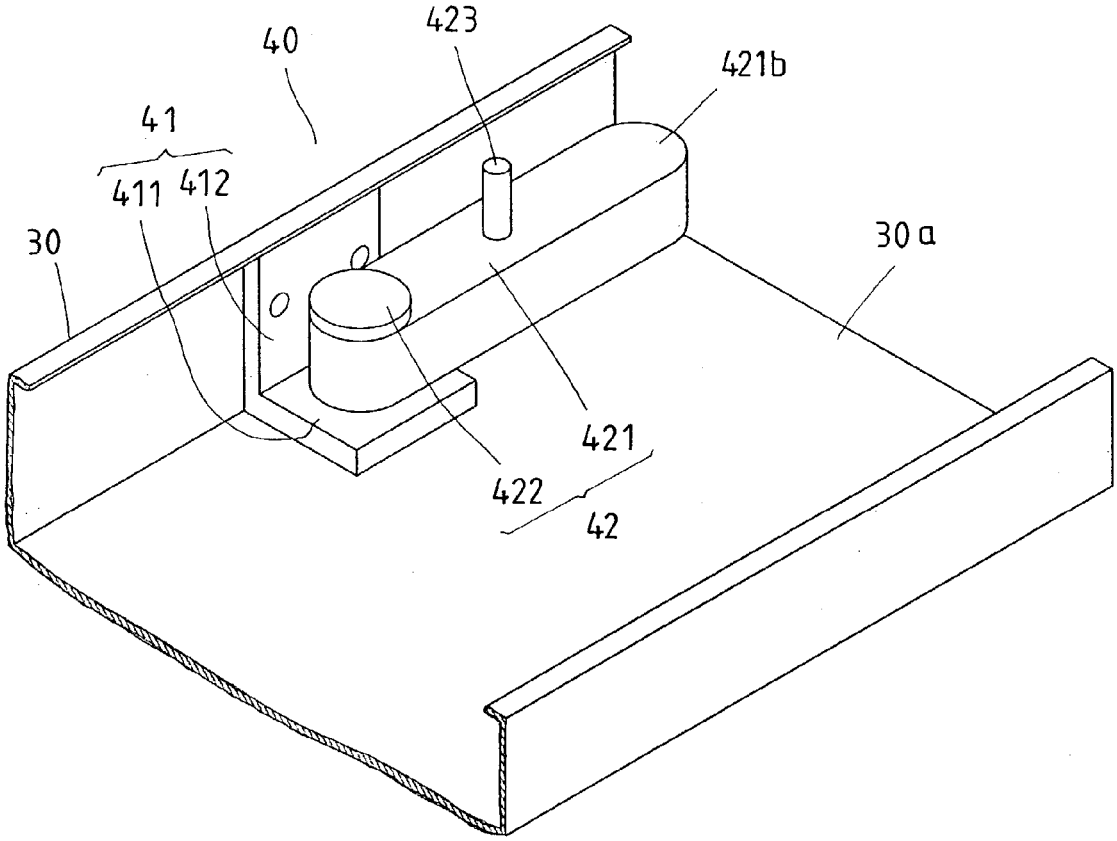
FIG. 2 is a perspective view of the workpiece holding-down structure according to a first embodiment of the present invention.
Figure 3:
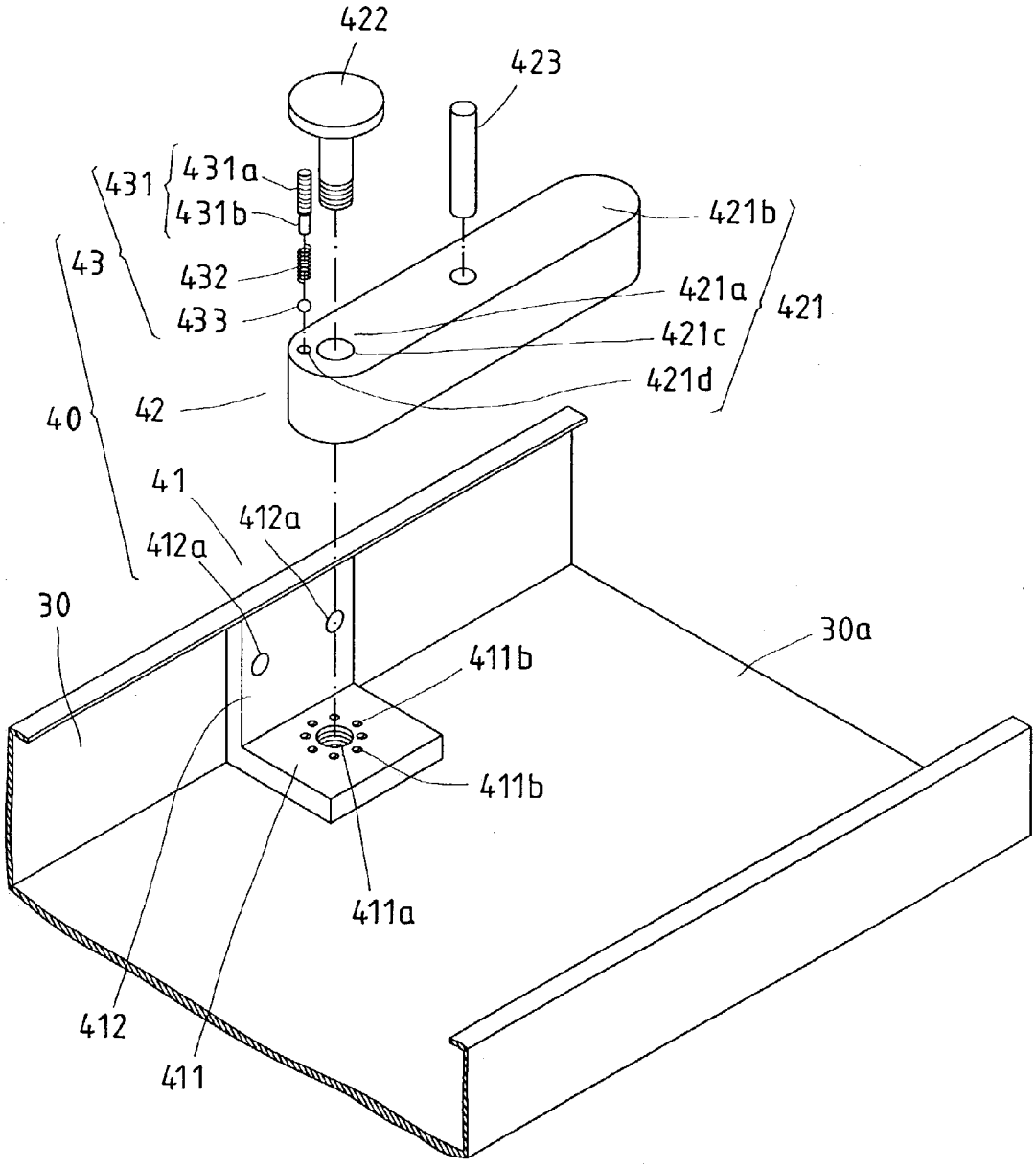
FIG. 3 is an exploded view of the workpiece holding-down structure according to the first embodiment of the present invention.

Referring to FIGS. 2 and 3, the workpiece holding-down structure for blind cutting machine according to the first embodiment of the present invention is comprised of the aforesaid workpiece feeder 30 and a clamp 40. The clamp 40 comprises a mounting base 41, a clamping bar unit 42, and a positioning mechanism 43.

The mounting base 41 comprises a rectangular base plate 411 and a side plate 412 extended from one side of the base plate 411 at right angles. The base plate 411 has a screw hole 411*a*, and a plurality of positioning holes 411*b* equiangularly spaced around the screw hole 411*a*. According to this embodiment, the number of the positioning holes 411*b* is 8. Alternatively, the base plate 411 can be made having 16 or more locating holes. The side plate 412 has two mounting holes 412*a* fixedly fastened to one vertical lateral sidewall of the workpiece feeder 30 by screws near the front side 30*a*.

The clamping bar unit 42 comprises a clamping bar 421, a pivot bolt 422, and a handle 423. The clamping bar 421 has a front end 421*a*, a rear end 421*b*, a pivot hole 421*c* in the front end 421*a*, and a threaded locating hole 421*d* in the front end in parallel to the pivot hole 421*c*. The pivot bolt 422 is inserted through the pivot hole 421*c* of the clamping bar 421 and threaded into the screw hole 411*a* to secure the clamping bar 421 to the mounting base 41, enabling the clamping bar 421 to be turned about the pivot bolt 422. The handle 423 is fixedly fastened to the clamping bar 421, having one end protruded over the top side of the clamping bar 421.

The positioning mechanism 43 is comprised of a locating rod 431, a spring member 432, and a steel ball 433. The locating rod 431 has a threaded rod body 431*a* and a tip 431*b* axially extended from one end of the threaded rod body 431*a*. The diameter of the tip 431*b* is smaller than the threaded rod body 431*a*. The threaded rod body 431*a* is threaded into the threaded locating hole 421*d* of the clamping bar 421, keeping the tip 431*b* suspended inside the threaded locating hole 421*d*. The spring member 432 is sleeved onto the tip 431*d* of the locating rod 431 and stopped at the bottom side of the threaded rod body 431*a* of the locating rod 431. The steel ball 433 is stopped at the bottom end of the spring member 432 remote from the locating rod 431. When installed, the spring member 432 imparts a downward pressure to the steel ball 433.

Figure 4:
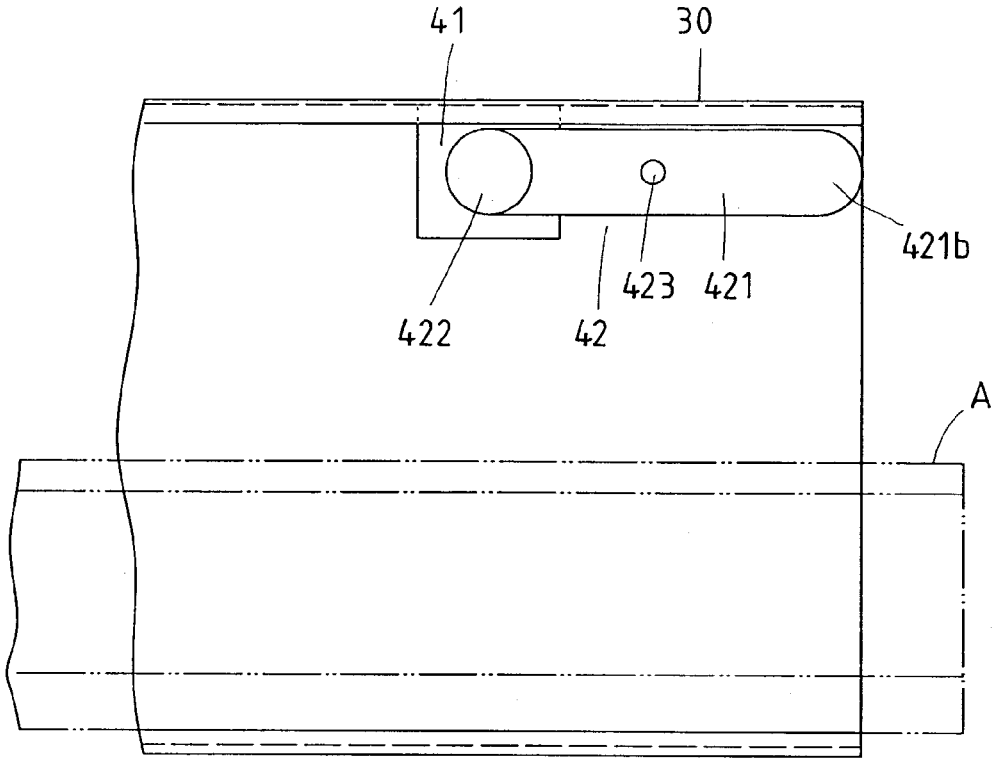
FIG. 4 is a schematic drawing showing a position of the clamp of the workpiece holding-down structure according to the first embodiment of the present invention.
Figure 5:
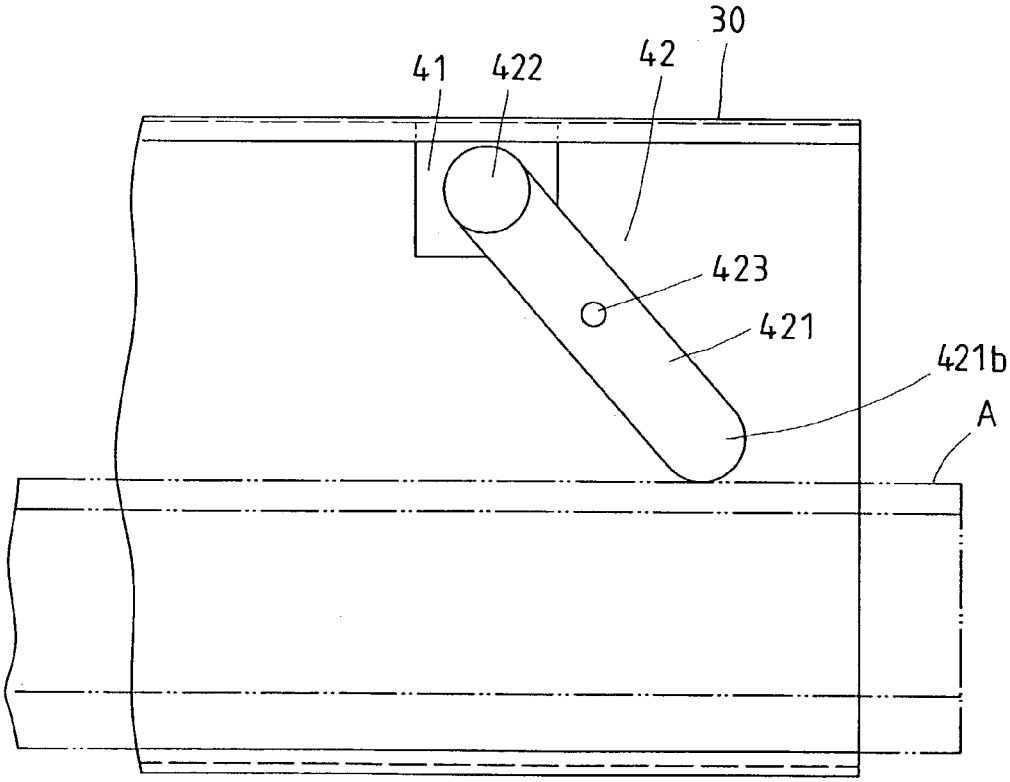
FIG. 5 is a schematic drawing showing another position of the clamp of the workpiece holding-down structure according to the first embodiment of the present invention.

Referring to FIGS. 4 and 5, during cutting operation, the blind A is put in the workpiece feeder 30, and then the operator pulls the handle 423 to turn the clamping bar 421 about the pivot bolt 422 and to force the rear end 421*b* of the clamping bar 421 against the blind A, and at the same time, the steel ball 433 is shifted from one positioning hole 411*b* of the mounting base 41 to another. When the parts of the blind A gathered together and stopped firmly in place against one vertical sidewall of the workpiece feeder 30 by the clamping bar 421, the steel ball 433 is engaged into the corresponding positioning hole 411*b* to lock the clamping bar 421. After cutting, the operator moves the handle 423 in the reversed direction to release the clamping bar 421 from the blind A, and then removes the blind A from the workpiece feeder 30.

The aforesaid first embodiment of the present invention has numerous advantages. One advantage is that the blind holding-down structure enables the workpiece to be rapidly and firmly clamped in position for cutting, improving the cutting efficiency. The other advantage of the blind holding-down structure is its simple structure for easy installation and maintenance.

Figure 6:
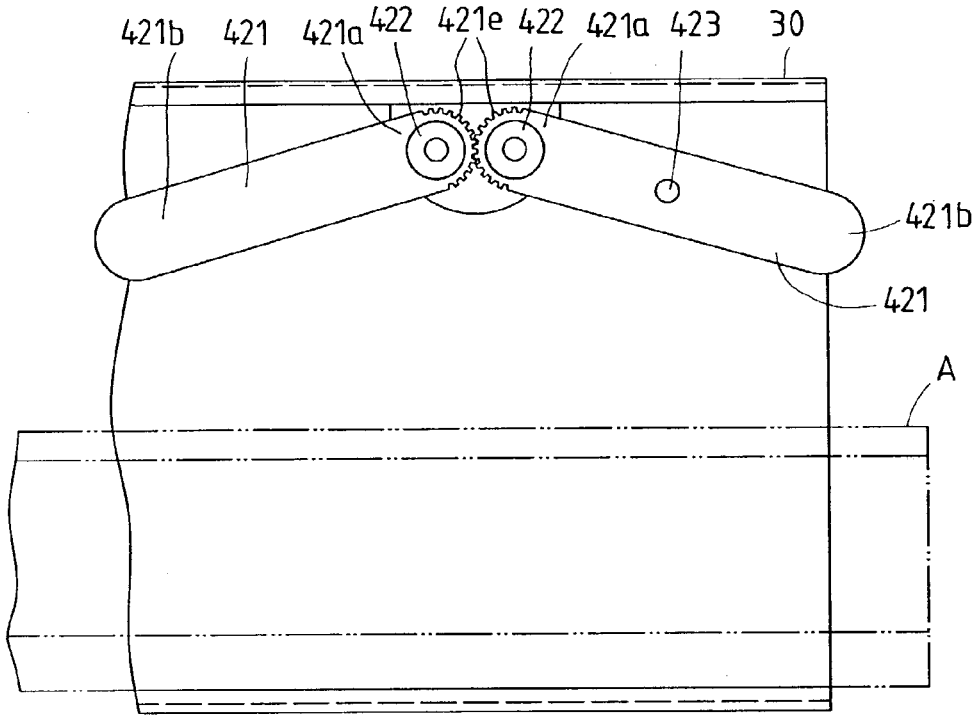
FIG. 6 is a schematic drawing showing a position of the clamp of the workpiece holding-down structure according to a second embodiment of the present invention.
Figure 7:
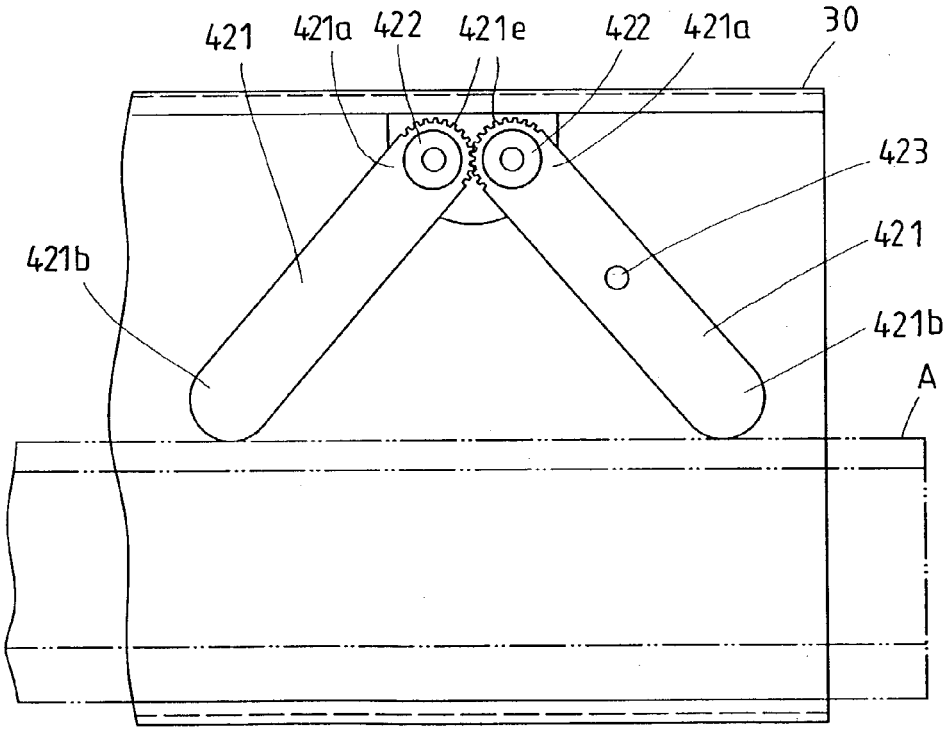
FIG. 7 is a schematic drawing showing another position of the clamp of the workpiece holding-down structure according to the second embodiment of the present invention.

FIGS. 6 and 7 show the second embodiment of the present invention. According to this embodiment, the clamping bar unit 42 is comprised of two clamping bars 421, two pivot bolts 422, and one handle 423. The clamping bars 421 each have a front end 421*a*, a rear end 421*b*, and a toothed portion 421*e* at the front end 421*a*. The clamping bars 421 are respectively pivoted to the bottom wall of the workpiece feeder 30 at one side by the pivot bolts 422, keeping the toothed portions 421*e* meshed. The handle 423 is fixedly fastened to one clamping bar 421, having one end protruded over the top side of the corresponding clamping bar 421. After the blind A has been put in the workpiece feeder 30 during a blind cutting operation, the operator needs only to pull the handle 423, and the clamping bars 421 are simultaneously turned about the respective pivot bolts 422 toward each other to hold down the parts of the blind A for cutting. Because two clamping bars 421 are used and clamped on the blind A, the parts of the blind A are tightly held down in position for cutting.

Figure 8:
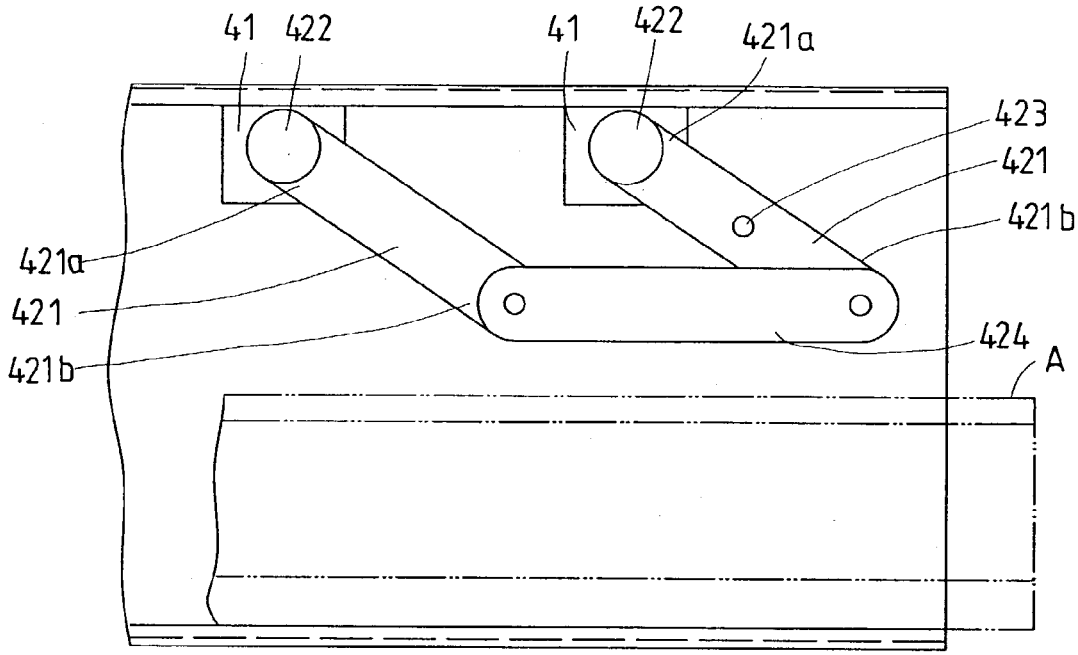
FIG. 8 is a schematic drawing showing a position of the clamp of the workpiece holding-down structure according to the third embodiment of the present invention.
Figure 9:
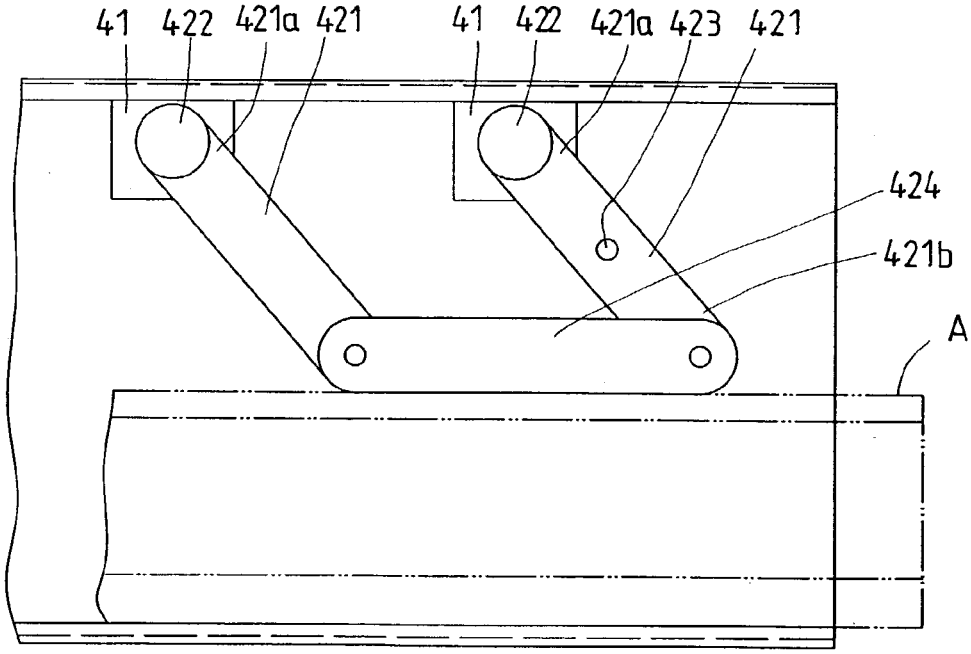
FIG. 9 is a schematic drawing showing another position of the clamp of the workpiece holding-down structure according to the third embodiment of the present invention.

FIGS. 8 and 9 show the third embodiment of the present invention. According to this embodiment, the clamp comprises two mounting bases 41, and a clamping bar unit 42. The clamping bar unit 42 is comprised of two clamping bars 421, two pivot bolts 422, a handle 423, and a link 424. The clamping bars 421 each have a front end 421*a* and a rear end 421*b*. The front ends 421*a* of the clamping bars 421 are respectively pivoted to the mounting bases 41 in the workpiece feeder 30 by the pivot bolts 422. The handle 423 is fixedly fastened to the clamping bar 421, having one end protruded over the top side of the clamping bar 421. The link 424 is coupled between the second ends 421*b* of the clamping bars 421, keeping the clamping bars 421 in parallel. When the operator pulling the handle 423 toward the blind A in the workpiece feeder 30, the clamping bars 421 and the link 424 are simultaneously moved toward the blind A, thereby causing one long side of the link 424 to be pressed on the blind against one vertical sidewall of the workpiece feeder 30, and therefore the blind A is held down in position for cutting.

In the aforesaid embodiments of the present invention, the positioning mechanism can be set in one of a series of positions (8 or 16 subject to the number of the locating holes). Any of a variety of stepless locking means may be used to lock the clamping bar unit. However, the positioning mechanism is not imperative. For cutting blinds of light materials, the positioning mechanism can be eliminated.

What is claimed is:

1. A blind cutting machine and blind holding-down structure to hold down a blind to be cut by a cutter unit of the blind cutting machine, the blind holding-down structure comprising:

a workpiece feeder arranged to receive a blind to be cut, said workpiece feeder having a front side abutted against the cutter unit of the blind cutting machine, and a rear side;

a clamp bar unit having a front end, a rear end, and a pivot hole formed at said front end, a positioning mechanism being mounted on said clamp bar unit; and a mounting base mounted into said pivot hole of said clamp bar unit by a pivot bolt for connection with said workpiece feeder and said clamp bar unit to enable pivoting movement of said clamp bar unit, said mounting base having positioning holes;

wherein the mounting base has a plurality of said positioning holes equiangularly spaced around a screw hole, and said clamp bar unit has a clamping bar having said pivot hole defined therein and a threaded locating hole defined therein close to said pivot hole; and wherein said positioning mechanism comprises a locating rod having a threaded rod body threaded into said threaded locating hole and a tip axially extended downwardly and extended from said threaded rod body, a spring member sleeved onto the tip of said locating rod and stopped at a bottom side of said threaded rod body, and a steel ball mounted on a bottom end of said spring member remote from said locating rod and adapted to selectively engage one of said positioning holes.

2. The workpiece holding-down structure as claimed in claim 1, wherein said clamping bar unit comprises a handle located at a predetermined position.

3. The workpiece holding-down structure as claimed in claim 2, wherein said handle is inserted into said clamp bar unit.

4. The workpiece holding-down structure as claimed in claim 2, wherein said handle is located at one of a center and the rear end of said clamp bar unit.

5. The workpiece holding-down structure as claimed in claim 1, wherein said pivot bolt is a threaded rod inserted through said pivot hole in said clamping bar and threaded into said screw hole to pivotally secure said clamping bar to said workpiece feeder.

6. The workpiece holding-down structure as claimed in claim 1, wherein said mounting base is fixedly fastened to said workpiece feeder at one lateral side of said workpiece feeder.

* * * * *